US010125953B2

(12) United States Patent
Quadri et al.

(10) Patent No.: US 10,125,953 B2
(45) Date of Patent: Nov. 13, 2018

(54) STAGE LIGHT FIXTURE, IN PARTICULAR MULTISOURCE STAGE LIGHT FIXTURE

(71) Applicant: CLAY PAKY S.P.A., Seriate (IT)

(72) Inventors: Pasquale Quadri, Torre De' Roveri (IT); Francesco Campetella, Pesaro (IT)

(73) Assignee: CLAY PAKY S.P.A., Seriate (IT)

( * ) Notice: Subject to any disclaimer, the term of this patent is extended or adjusted under 35 U.S.C. 154(b) by 55 days.

(21) Appl. No.: 14/909,367

(22) PCT Filed: Aug. 12, 2014

(86) PCT No.: PCT/IB2014/063881

§ 371 (c)(1),
(2) Date: Feb. 1, 2016

(87) PCT Pub. No.: WO2015/022644

PCT Pub. Date: Feb. 19, 2015

(65) Prior Publication Data

US 2016/0178165 A1 Jun. 23, 2016

(30) Foreign Application Priority Data

Aug. 12, 2013 (IT) ..... MI2013A1385

(51) Int. Cl.

| | |
|---|---|
| ***F21V 14/00*** | (2018.01) |
| ***F21V 14/06*** | (2006.01) |
| ***F21V 14/02*** | (2006.01) |
| ***F21V 21/30*** | (2006.01) |
| ***F21V 5/00*** | (2018.01) |
| *F21W 131/406* | (2006.01) |

(Continued)

(52) U.S. Cl.

CPC ..... *F21V 14/06* (2013.01); *F21V 5/007* (2013.01); *F21V 14/02* (2013.01); *F21V 21/30* (2013.01); *F21W 2131/406* (2013.01); *F21Y 2105/10* (2016.08); *F21Y 2115/10* (2016.08)

(58) Field of Classification Search

CPC ..... F21S 10/007; F21S 10/026; F21K 9/65; F21V 14/06; F21V 14/02; F21V 21/30; F21W 2131/406

USPC ..... 362/18

See application file for complete search history.

(56) References Cited

U.S. PATENT DOCUMENTS

| | | | | |
|---|---|---|---|---|
| 6,474,837 | B1 | 11/2002 | Belliveau | |
| 7,226,185 | B2 * | 6/2007 | Dolgin | G02B 3/00 362/239 |

(Continued)

FOREIGN PATENT DOCUMENTS

| | | |
|---|---|---|
| EP | 2 309 296 | 4/2011 |
| EP | 2 589 861 | 5/2013 |

(Continued)

*Primary Examiner* — Julie Bannan

(74) *Attorney, Agent, or Firm* — Leason Ellis LLP

(57) ABSTRACT

A stage light fixture is provided with a plurality of light sources configured to emit respective light beams along respective optical axes; and a plurality of optical elements, each of which is configured to modify the direction of the rays defining the light beam of a respective light source; at least one light source of the plurality of light sources and the respective optical element of the plurality of optical elements being movable one with respect to the other along a direction transversal to the optical axis of the light source.

13 Claims, 4 Drawing Sheets

(51) Int. Cl.
*F21Y 105/10* (2016.01)
*F21Y 115/10* (2016.01)

(56) References Cited

U.S. PATENT DOCUMENTS

| | | | | |
|---|---|---|---|---|
| 8,651,694 | B2 * | 2/2014 | Becker | F21V 14/06 362/242 |
| 9,651,222 | B2 * | 5/2017 | Jorgensen | F21V 14/04 |
| 2006/0056058 | A1 * | 3/2006 | Chong | G02B 13/001 359/694 |
| 2010/0039819 | A1 * | 2/2010 | Fournier | F21V 14/06 362/268 |
| 2010/0073783 | A1 | 3/2010 | Sun | |
| 2011/0063836 | A1 * | 3/2011 | Salm | F21V 5/04 362/235 |
| 2012/0121244 | A1 * | 5/2012 | Stavely | F21V 5/007 396/175 |
| 2012/0212965 | A1 * | 8/2012 | Nakamura | F21V 13/04 362/311.09 |
| 2013/0107513 | A1 * | 5/2013 | Lundberg | F21V 14/04 362/231 |
| 2014/0301071 | A1 * | 10/2014 | Jorgensen | F21V 14/06 362/231 |
| 2015/0159830 | A1 * | 6/2015 | Joergensen | F21V 5/007 362/237 |

FOREIGN PATENT DOCUMENTS

| | | |
|---|---|---|
| WO | WO 01/59360 | 8/2001 |
| WO | WO 03/025458 | 3/2003 |

* cited by examiner

STAGE LIGHT FIXTURE, IN PARTICULAR MULTISOURCE STAGE LIGHT FIXTURE

CROSS REFERENCE TO RELATED APPLICATIONS

The present application is a U.S. National Phase of International Patent Application PCT/IB2014/063881, filed on Aug. 12, 2014, which claims priority to Italian Application No. MI2013A001385, filed on Aug. 12, 2013, each of which is incorporated by reference as if expressly set forth in their respective entireties herein.

TECHNICAL FIELD

The present invention relates to a stage light fixture. In particular, the present invention relates to a multisource stage light fixture.

BACKGROUND ART

The need to implement innovative, surprising stage effects is increasingly more felt in the stage lighting sector.

Furthermore, over the past years, most of the efforts have been concentrated in the field of multisource type stage light fixtures, preferably with LEDs.

However, in the sector of multisource stage light fixtures, particular importance is usually conferred to the perception of the stage light fixture by the observer. Thus, most stage effects concern visible animations when the stage light fixture is observed frontally. Little attention is dedicated to the stage effects of the projection of the beams generated by the light sources of the multisource stage light fixtures.

DISCLOSURE OF INVENTION

It is thus the object of the present invention to make a multisource stage light fixture which is capable of generating new stage effects.

In accordance with such objects, the present invention relates to a stage light fixture comprising:

a plurality of light sources configured to emit respective light beams along respective optical axes;

a plurality of optical elements, each of which is configured to modify the direction of the rays defining the light beam of a respective light source;

at least one light source of the plurality of light sources and the respective optical element of the plurality of optical elements being movable one with respect to the other along a direction transversal to the optical axis of the light source.

The relative movement between the light source and the respective optical element along a direction transversal to the optical axis of the light source determines a variation of the main direction of the light beam generated by the light source.

By virtue of the present invention, it is possible to control the variation of the main direction of one or more light beams emitted by the single light sources of the stage light fixture to generate a new, surprising stage effect. The stage effect is even more surprising in a environment in which fog is present (e.g. generated by a fog machine). Indeed, in foggy environments the light beams emitted by the stage light fixture are more visible. The main direction of at least one beam may be adjusted by means of a control of the relative movement between at least one light source and the respective optical element.

According to a preferred embodiment of the present invention, at least one light source of the plurality of light sources and the respective optical element of the plurality of optical elements are movable one with respect to the other along a direction parallel to the optical axis of the light source.

In this manner, a zoom effect on the projected light beam can be obtained. The zoom effect may be superimposed on the controlled main direction variation effect which can be obtained by virtue of the present invention to obtain a new, innovative stage effect.

According to a preferred embodiment of the present invention, the plurality of light sources and the plurality of optical elements rotate one with respect to the other on parallel planes.

In this manner, a total, simultaneous variation of the main directions of all the light beams can be obtained, except for the one generated by the central light source. A projection open in radial manner is obtained in this manner.

According to a preferred embodiment of the present invention, the plurality of light sources and the plurality of optical elements translate one with respect to the other on parallel planes. In this manner, a total, simultaneous variation of the main directions of all the light beams can be obtained, including the one generated by the central light source.

According to a preferred embodiment of the present invention, the plurality of light sources and the plurality of optical elements rotate one with respect to the other on two mutually inclined planes. In this manner, a total, simultaneous variation of the main directions of all the light beams can be obtained, including the one generated by the central light source.

According to a preferred embodiment of the present invention, the plurality of optical elements comprises at least one first assembly of optical elements arranged one next to the other along a first path and the plurality of light sources comprises a respective first assembly of light sources aligned and adapted to emit light beams hitting the first assembly of optical elements; the first assembly of optical elements and the first assembly of light sources being movable one with respect to the other along a direction transversal to the optical axis of one of the light sources of the first assembly of light sources.

In this manner, a simultaneous variation of the main directions of the light beams of only a first group of light beams can be obtained.

According to a preferred embodiment of the present invention, the plurality of optical elements comprises at least one second assembly of optical elements arranged one next to the other along a second path and the plurality of light sources comprises a respective second assembly of light sources aligned and adapted to emit light beams hitting the second assembly of optical elements; the second assembly of optical elements and the second assembly of light sources being movable one with respect to the other along a direction transversal to the optical axis of one of the light sources of the second assembly of light sources.

In this manner, it is possible to obtain a simultaneous variation of the main directions of the light beams also of a second assembly of light beams different from the first assembly.

According to a preferred embodiment of the present invention, the first path is circular and the second path is circular, concentric to the first path and within the first path.

In this manner, a simultaneous variation of the main directions of the light beams arranged along a first ring and also of the light beams arranged along a second ring different from the first ring can be obtained. This allows to obtain a particular, innovative stage effect.

According to a preferred embodiment of the present invention, the first assembly of optical elements is moveable with respect to the first assembly of light sources and the second assembly of optical elements is moveable with respect to the second assembly of light sources; the first assembly of optical elements being movable independently from the second assembly of optical elements.

In this manner, the variation of the main directions of the light beams arranged along a first ring may be adjusted independently from the variation of the main directions of the light beams arranged along a second ring different from the first ring. This allows to obtain a new, particular stage effect.

According to a preferred embodiment of the present invention, the plurality of optical elements comprises at least two optical elements having emission faces of different shape one from the other.

By virtue of the fact that at least two optical elements have emission faces of different shape, the available surface defined by the projection opening of the casing, which is generally circular, can be exploited as best, and the emission area defined by the sum of the emission areas of the plurality of optical elements can be increased.

This guarantees an increase of efficiency of the stage light fixture with respect to the prior art. Indeed, the performance of the stage light fixture according to the present invention is better than the stage light fixtures of the prior art in which all the optical elements have the same shape (round or hexagonal etc.).

BRIEF DESCRIPTION OF THE DRAWINGS

Further features and advantages of the present invention will be apparent in the following description of a non-limitative embodiment with reference to the figures in the accompanying drawings, in which.

BEST MODE FOR CARRYING OUT THE INVENTION

Figure 1:
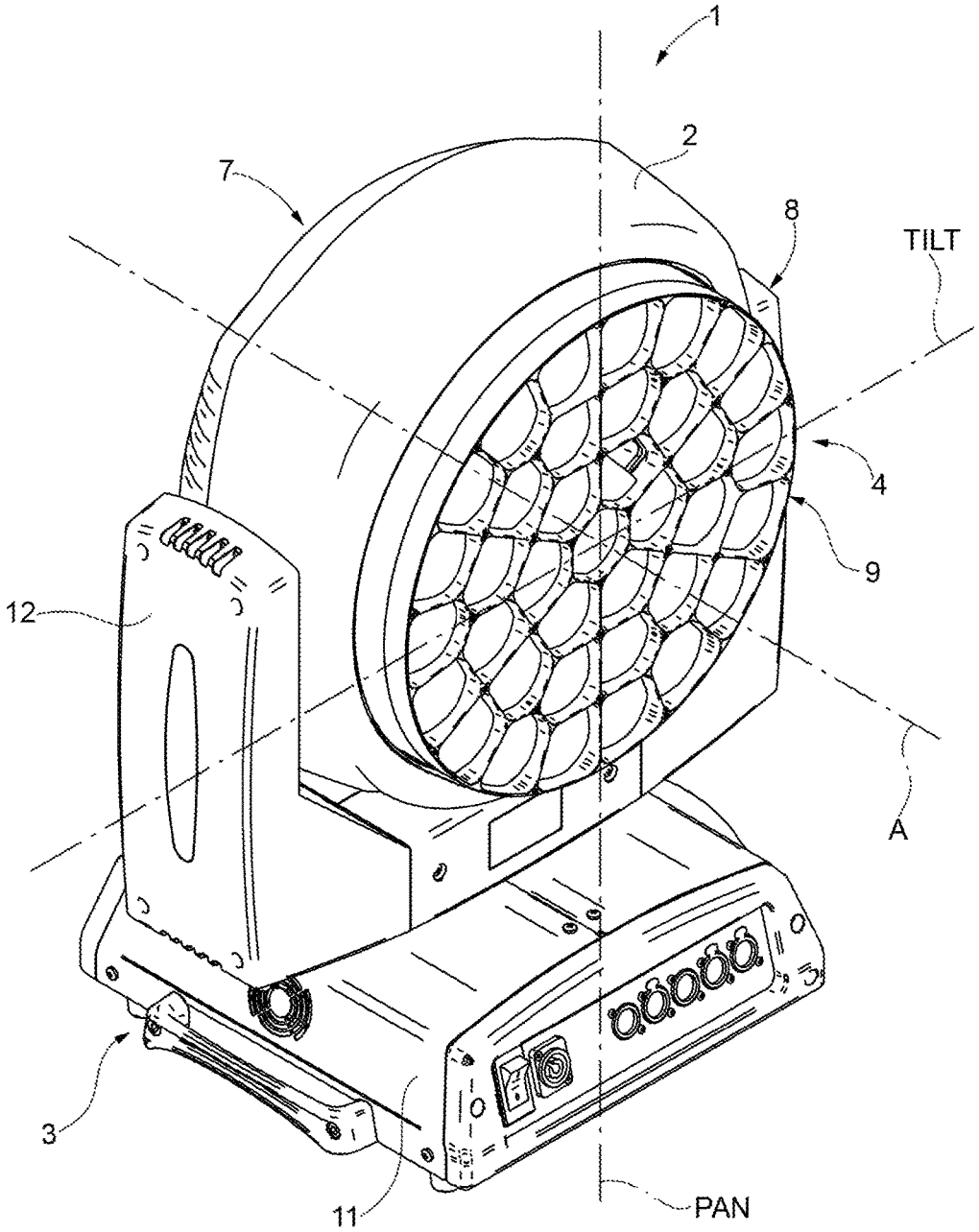
FIG. 1 is a perspective view, with parts removed for clarity, of a stage light fixture according to the present invention.

In FIG. 1, reference numeral 1 indicates a stage light fixture comprising a casing 2, supporting means 3, configured to support and actuate the casing 2, a plurality of light sources 4 and a plurality of optical elements 5.

The casing 2 extends along a longitudinal axis A and has a first closed end 7 and a second end 8, opposite to first closed end 7 along axis A, and provided with a projection opening 9. In the non-limiting example described and illustrated here, the projection opening 9 has a substantially circular section and defines a circular-shaped projection area AP.

In a variant (not shown) the projection opening 9 has an elliptical, instead of circular, shape.

The supporting means 3 are configured to allow the casing 2 to rotate about two orthogonal axes, commonly named PAN and TILT axes. In particular, the supporting means 3 comprise a base 11 to which a fork 12 is coupled in rotational manner about the PAN axis. The fork 12 supports the casing 2 in rotational manner about the TILT axis.

The actuation of the supporting means 3 is regulated by a control device (not shown in the accompanying figures). The control device may be remotely managed also preferably by means of DMX protocol communications. The plurality of light sources 4 is arranged inside the casing 2.

Figure 2:
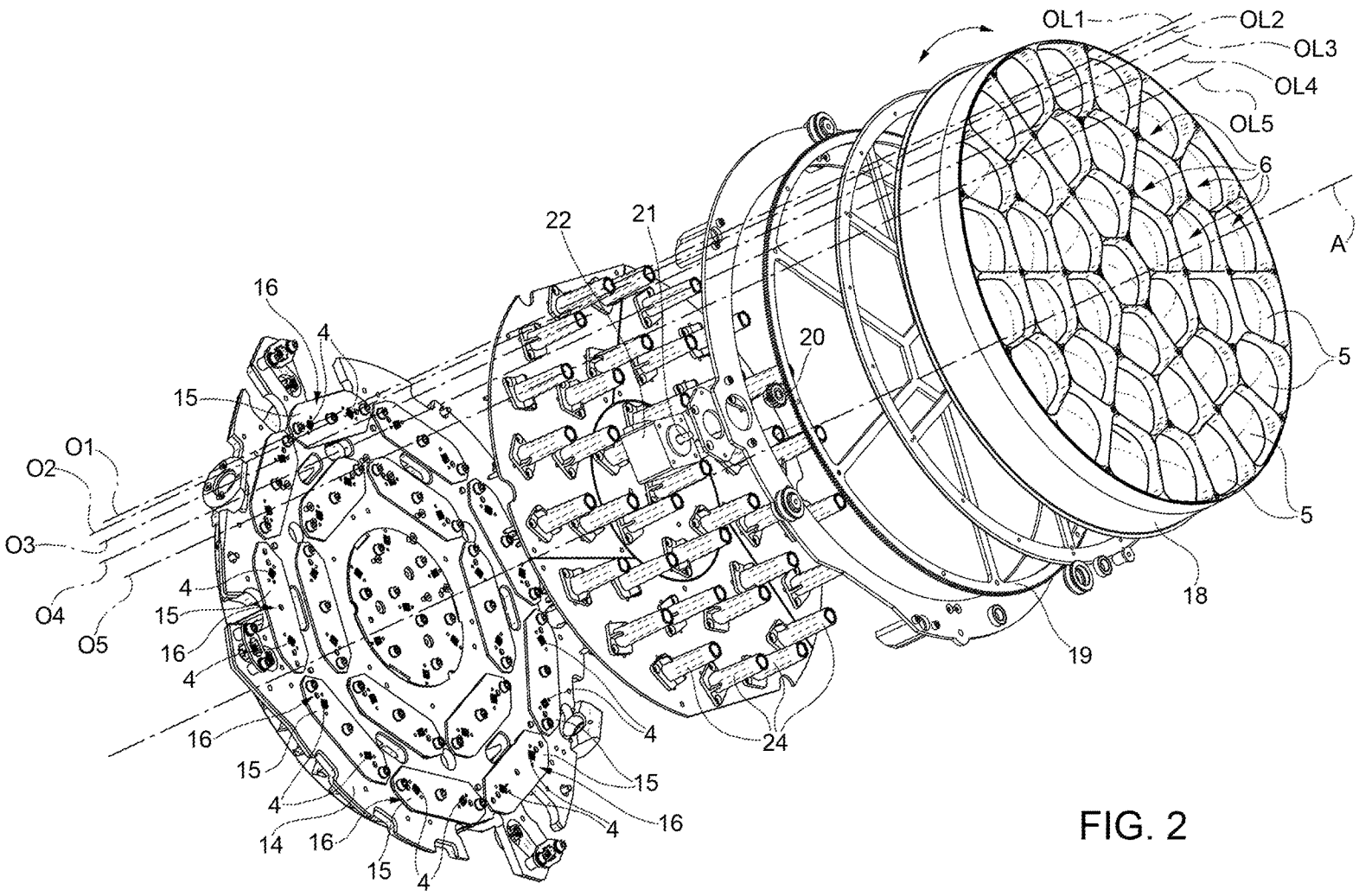
FIG. 2 is a diagrammatic exploded view, with parts removed for clarity, of a detail of the stage light fixture in FIG. 1.

With reference to FIG. 2, the light sources 4 are configured to emit the respective light beams along respective optical axes O1, O2, O3, O4 . . . On (not all axes are shown for the sake of simplicity).

In the non-limiting example described and illustrated here, and there are thirty-seven light sources 4 and the optical axes O1, O2, O3, O4 . . . On are parallel to the axis of the stage light fixture A.

Indeed, the plurality of light sources 4 is supported by a supporting plate 14, which is coupled to a supporting structure (not shown in the accompanying figures) integral with the casing 2 and arranged orthogonal to the axis A of the casing 2.

In detail, the light sources 4 are integrated in one or more electronic boards 15 (diagrammatically shown in FIG. 2), which are supported by the supporting plate 14 by means of a coupling system 16.

Preferably, the coupling system 16 is configured so as to allow, if required, to uncouple the electronic boards 15 in which the light sources 4 are integrated from the supporting plate 14 (e.g. to replace one or more light sources).

Preferably, the coupling system 16 comprises screws configured to fix the boards on which the light sources 4 are mounted to the supporting plate 14.

In the non-limiting example described and illustrated here, the light sources 4 are defined by LEDs (Light Emitting Diodes).

Preferably, the LEDs used in the stage light fixture according to the present invention are LEDs of the RGBW type.

Preferably, the light sources 4 are uniformly distributed along the supporting plate 14 so as to generate a plurality of uniformly distributed beams.

The optical elements 5 are arranged downstream of the light sources 4 along axis A of the casing 2 and are supported by a frame 18 coupled to the casing 2 near the second end 8.

Each optical element 5 is arranged so as to intercept the light beam of a respective light source 4.

Hereinafter, the expression "optical element 5" means an optical device configured to modify the direction of the rays of the light beam which hit it.

For example, the plurality of optical elements 5 may comprise lenses and/or an assembly of lenses and/or collimators and/or reflectors and/or prismatic elements.

In the non-limiting example described and illustrated here, each optical element 5 is defined by a lens, preferably plane-convex.

In a variant (not shown), each optical element 5 is defined by a Fresnel type lens.

Substantially, the expression "optical element" means an active element from the optical point of view capable of determining a variation of inclination of the light rays which hit the surface of the optical element.

Each optical element 5 comprises an inlet face (not shown in the accompanying figures), which faces towards the respective light source 4, and an emission face 6, opposite to the inlet face and characterized by its own emission area A1, A2, A3 capable of emitting light rays, the inclination of which was modified during the crossing of the optical element 5 itself.

In the non-limiting case described and illustrated here, the emission area of the optical elements 5 coincides with the extension of the emission face 6 of the optical elements 5 themselves, being the lens an emitting surface itself.

Each lens 5 is provided with a working optical axis OL1, OL2, OL3 . . . OLn.

In the non-limiting example described and illustrated here, there are thirty-seven lenses 5, which are supported by the frame 18, so that the working optical axes OL1, OL2, OL3, OL4 . . . OLn are arranged substantially parallel to the axis of the stage light fixture A.

Thus, a surface transparent to light rays cannot be considered an optical element because it cannot modify the direction of the light rays which hit it.

Figure 3:
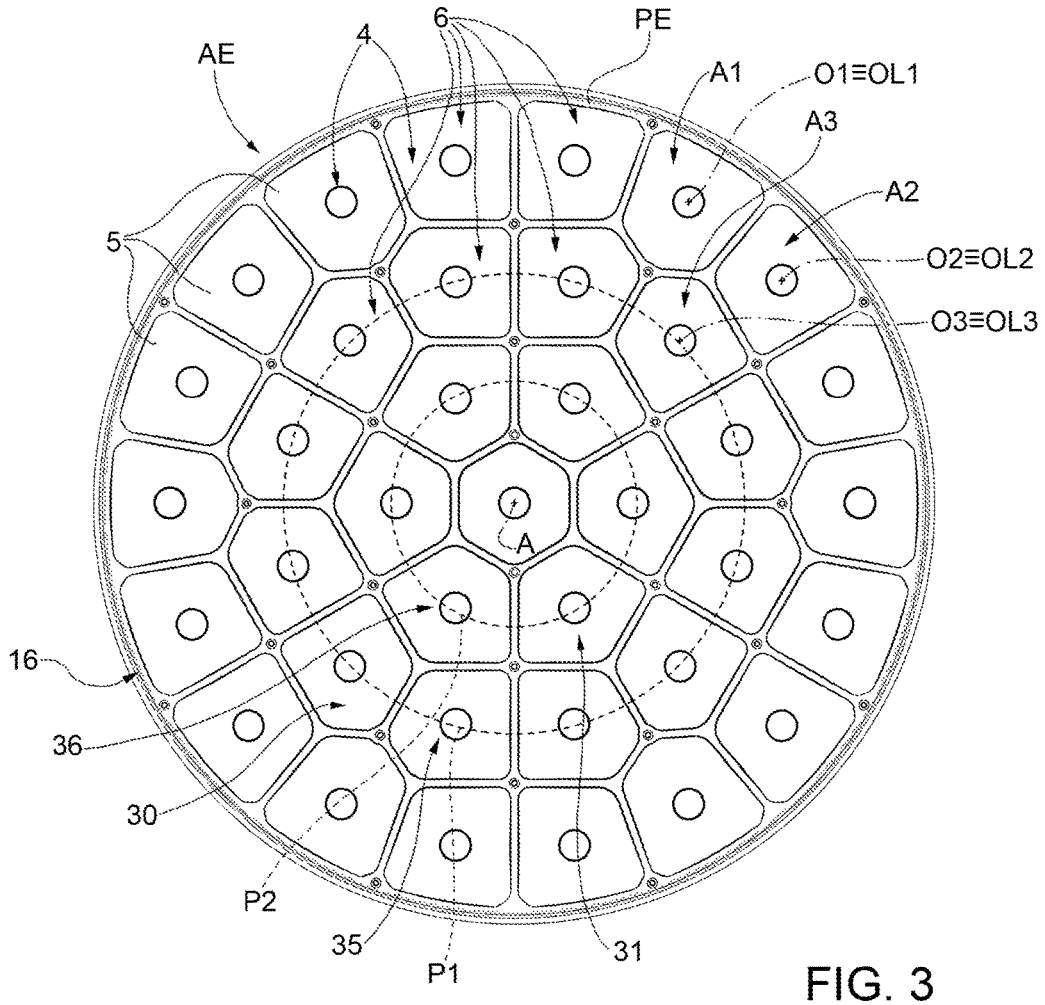
FIG. 3 is a diagrammatic front view, with parts removed for clarity, of a third detail of the stage light fixture in FIG. 1, in a first operative position.

With reference to FIG. 3, the optical elements 5 are shaped and arranged one next to the other so as to define a total emission area AE of the light beams having an emission outline PE defined by a perimeter assembly 16 of lens. The total emission area AE is thus defined as the sum of the emission areas A1, A2, A3 . . . An of each optical element 5.

The plurality of optical elements 5 comprises at least two optical elements 5 having respective emission faces 6 of different shape one with respect to the other.

In the non-limiting example described and illustrated here, the plurality of optical elements 5 comprises optical elements 5 having polygonal-shaped emission faces 6. In particular, the plurality of optical elements 5 comprises an optical element 5 having hexagonal-shaped emission face 6, twenty-four optical elements 5 having polygonal-shaped emission faces 6, and twelve optical elements having quadrangular-shaped emission faces 6.

It is understood that the plurality of optical elements 5 may include optical elements 5 having emission faces 6 also of other shapes.

Substantially, the shape of the optical elements 5 is defined so that, once arranged one next to the other, the optical elements 5 define a total emission area AE which is as close to the projection area AP defined by the projection opening 9 as possible.

In particular, the shape of the emission faces 6 of the optical elements 5 is defined so that, once arranged one next to the other, the optical elements 5 define a total emission area AE of the light beams which is greater or equal to 80% of the projection area AP, preferably greater or equal than 85% of the projection area AP, preferably greater or equal to 95% of the projection area AP.

The frame 18 is shaped so as to support the optical elements 5 one next to the other according to the preferred arrangement. Preferably, the frame 18 is made so as to minimize the non-emitting areas present between one optical element 5 and the next. Preferably, the frame 18 comprises two flanges (not shown in accompanying figures) having substantially the same frame which can be coupled to one another. The optical elements 5 are arranged between the flanges. In this manner, the optical elements 5 are retained between the two coupled flange. This allows to avoid the use of coupling means which require to pierce or process the optical elements 5.

In a variant (not shown), the optical elements 5 are made in one piece. In this manner, the frame 18 will be coupled at the optical elements 5 of the perimeter assembly only, thus minimizing the non-emitting areas and increasing the extension of the emitting area AE.

According to the present invention, at least one light source 4 of the plurality of light sources 4 and the respective optical element 5 of the plurality of optical elements 5 are moveable one with respect to the other along a direction transversal to the optical axis O1, O2, O3, . . . On of the light source 4 and, preferably, also along a direction parallel to the optical axis O1, O2, O3, . . . On of the light source 4.

The relative movement between the light source 4 and the respective optical element 5 along a direction transversal to the optical axis determines a variation of the main direction of the light beam emitted by the source assembly-optical element. Where the expression "main direction" hereinafter means the direction defined by the union of the center of gravity of an emitting surface defined at the optical element 5 with the center of gravity of a surface illuminated by the beam at a distance greater than 5 meters from the optical element 5.

The relative movement between the light source 4 and the respective optical element 5 along the optical axis, instead, determines a variation of the width of the beam, meaning the opening angle of the beam itself. In this manner, the relative movement between the light source 4 and the respective optical element 5 along the optical axis determines a zoom effect. In the non-limiting example described and illustrated here, the zoom effect provides a variation of the width of the opening angle of the beam which goes from a minimum of 4° (configuration in which the light beams projected by the optical elements are clearly distinguished one from the other) to a maximum of 60° (configuration in which all the light beams projected by the single optical elements are superimposed to form a single light beam).

In the non-limiting example described and illustrated here, the relative displacement between the light source 4 and the optical element 5 determines a misalignment between the optical axis O1, O2, O3, . . . On of the light source 4 and the optical axis O1, O2, O3, . . . On of the optical element 5. This determines a variation of the main direction of the light beam.

In the non-limiting example described and illustrated here, the plurality of light sources 4 is supported by the supporting plate 14 and is preferably distributed along a first plane, while the plurality of optical elements 5 is supported by the frame 18 and is preferably distributed along a second plane.

The plurality of light sources 4 and the plurality of optical elements 5 rotate one with respect to the other on parallel planes.

With reference to FIG. 2, the frame 18 is rotatable with respect to the supporting plate 14 (as shown by the arrow in FIG. 2).

In the non-limiting example described and illustrated here, the frame 18 can perform a complete 360° rotation. Preferably, the frame 18 may rotate in both directions. More preferably, the frame 18 may rotate at variable speed.

In particular, the frame 18 is coupled to a toothed wheel 19, which cooperates with at least one pinion 20 coupled to the shaft 21 of a respective motor 22.

The motor 22 is preferably a stepper type motor type, the actuation of which is controlled by control device (not shown). As previously mentioned, the control device may be managed also remotely preferably by means of DMX protocol communications.

The actuation controlled by the motor 22 allows to adjust the degree of rotation, the rotation speed and the rotation direction of the plurality of optical elements. In this manner, a plurality of different stage effects can be obtained.

Figure 4:
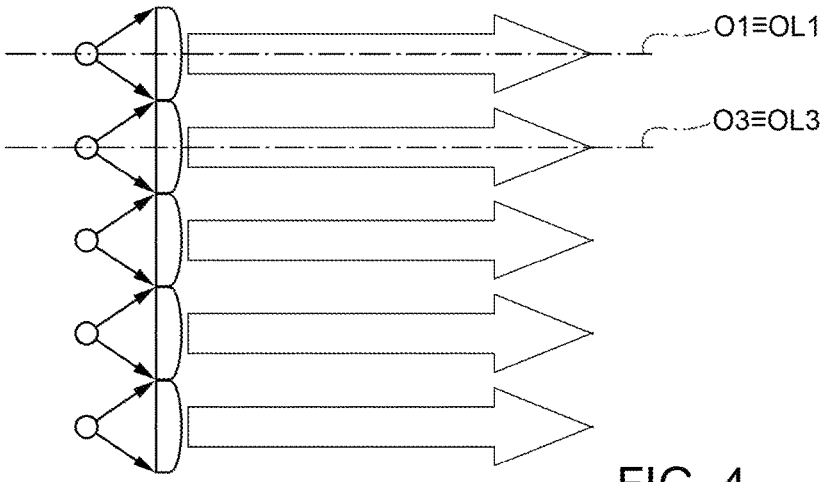
FIG. 4 is a side diagrammatic view, with parts in section and parts removed for clarity, of the detail in FIG. 3 in the first operative position.

FIG. 3 shows a first operative configuration in which the plurality of optical elements 5 is arranged so that the optical axis O1, O2, O3, . . . On of the light sources 4 is aligned with the working optical axis OL1, OL2, OL3, OL4 . . . OLn of the optical elements 5. In this operative position, the beams emitted by the plurality of source/optical element assemblies have a direction substantially coinciding with the optical axis O1, O2, O3, . . . On of the light sources 4 and the working optical axis OL1, OL2, OL3, OL4 . . . OLn of the optical elements 5 (FIG. 4).

Figure 5:
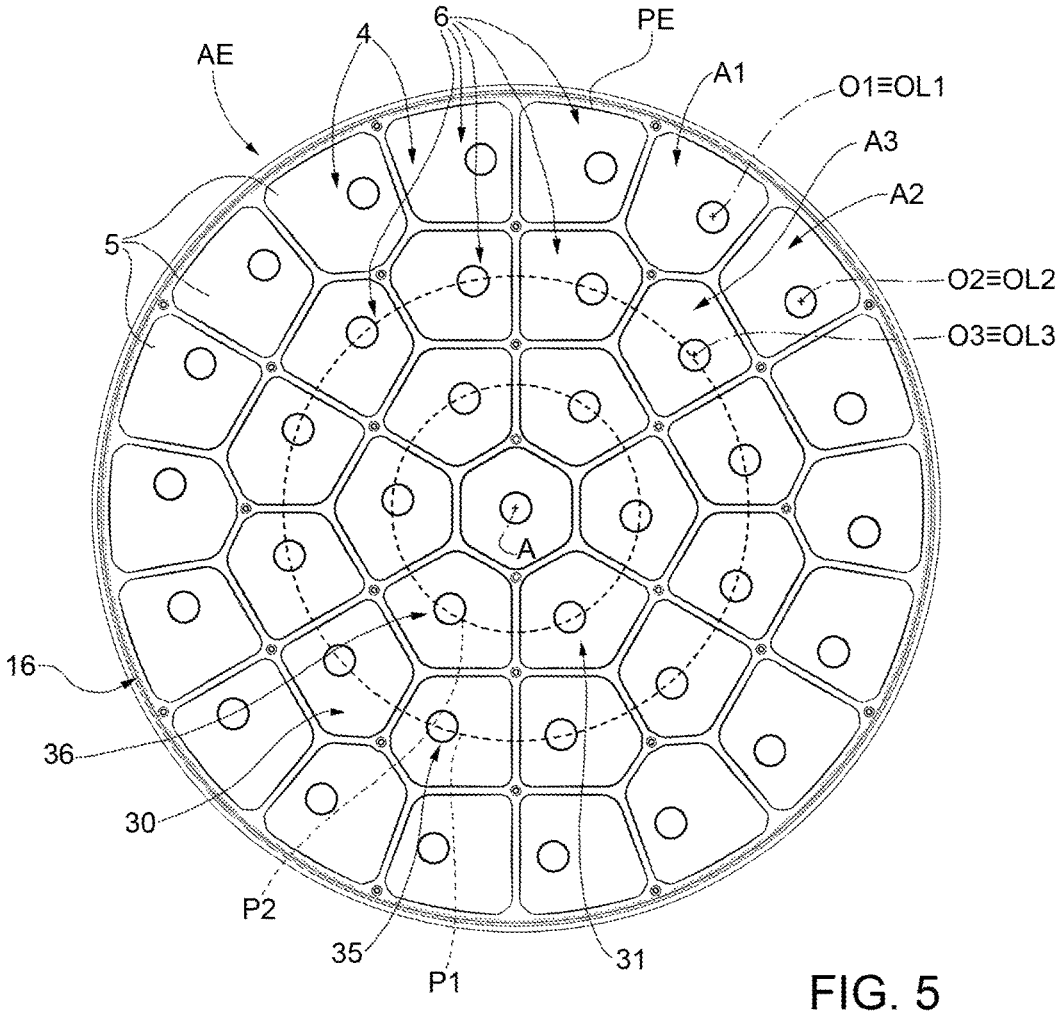
FIG. 5 is a diagrammatic front view, with parts in section and parts removed for clarity, of the detail in FIG. 3 in a second operative position.
Figure 6:
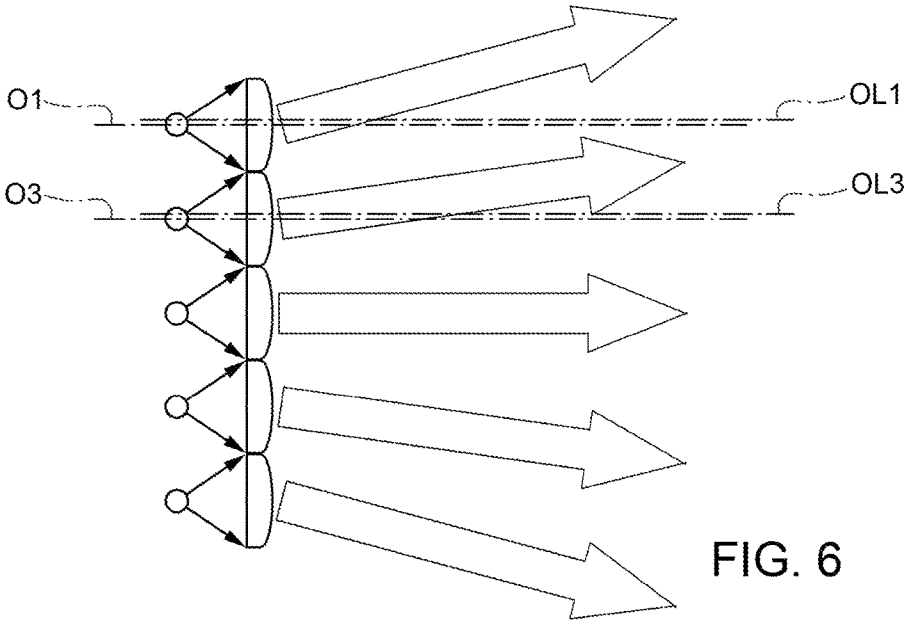
FIG. 6 is a side diagrammatic view, with parts in section and parts removed for clarity, of the detail in FIG. 3 in the second operative position.

FIG. 5 shows a second operative configuration in which the plurality of optical elements 5 is rotated with respect to the plurality of light sources 4 so that the optical axis O1, O2, O3, . . . On of the light sources 4 is misaligned with the working optical axis OL1, OL2, OL3, OL4 . . . OLn of the optical elements 5.

In this operative position, the beams emitted by the plurality of source/optical element assemblies have a main direction substantially diverging with respect to the main direction of the beams in the first operative position and not coinciding with the optical axis O1, O2, O3, . . . On of the light sources 4 and with the optical axis OL1, OL2, OL3, OL4 . . . OLn of the optical elements 5.

In this manner, there is the projection of a plurality of light beams in radial manner.

According to a variant (not shown) of the present invention, the plurality of light sources 4 and the plurality of optical elements 5 translate with respect to one another on parallel planes.

According to a variant (not shown) of the present invention, the plurality of light sources 4 and the plurality of optical elements 5 rotate one with respect to the other on planes inclined one with respect to the other.

With reference to FIG. 3 and to FIG. 5, in a further variant of the present invention the plurality of optical elements 5 comprises at least one first assembly 30 of optical elements 5 arranged one next to the other along a first circular path P1 and a second assembly 31 of optical elements 5 arranged one next to the other along a second circular path P2, concentric to the first path P1 and inside the first path P1, and the plurality of light sources 4 comprises a respective first assembly 35 of light sources 4 aligned and adapted to generate light beams which hit the first assembly 30 of optical elements 5 and a second assembly 36 of light sources 4 aligned and adapted to generate light beams which hit the second assembly 31 of optical elements 5.

Preferably, the first assembly 30 of optical elements 5 and the first assembly 35 of light sources 4 are moveable one with respect to the other in a direction transversal to the optical axis O1, O2, O3, . . . On of one of the light sources 4 of the first assembly of light sources 4 and the of second assembly 31 of the optical elements 5, and the second assembly 36 of light sources 4 is moveable one with respect to the other in a direction transversal to the optical axis O1, O2, O3, . . . On of one of the light sources 4 of the second assembly of light sources 4.

More preferably, the first assembly 30 of optical elements 5 is movable with respect to the first assembly 35 of light sources 4, and the second assembly 31 of optical elements 5 is movable with respect to the second assembly 36 of light sources 4; the first assembly 30 of optical elements 5 being movable independently from the second assembly 31 of optical elements 5. In this manner, the variation of the main direction of the beams of the first assembly 30 and of the second assembly 31 can be adjusted independently to obtain different stage effects.

With reference to FIG. 2, in the non-limiting example described and illustrated here, each light source 4 is coupled to a respective mixer device 24. The mixer device 24 is configured to collect the light beam emitted by the respective light source 4 and to mix it appropriately so as to generate a mixed and concentrated light beam.

In particular, the mixer device 24 has an elongated prismatic shape and extends along the optical axis O1, O2, . . . On of the light beam of the source to which it is coupled.

It is finally apparent that changes and variations may be made to the stage lighting fixture described herein without departing from the scope of protection of the accompanying claims.

The invention claimed is:

1. Stage light fixture (1) comprising:

a plurality of light sources (4) configured to emit respective light beams along respective optical axes (O1, O2, O3, . . . On);

a plurality of lenses (5), each of which is configured to modify the direction of the rays defining the light beam of a respective light source (4), the plurality of lenses (5) being supported by a rotatable frame (18);

a toothed wheel (19) that is coupled to a rear face of the rotatable frame (18) and is configured to mate with a device for controllably rotating the rotatable frame (18);

at least one of the one light source (4) of the plurality of light sources (4) or at least one of the respective optical element (5) of the plurality of lenses (5) being movable relative to a corresponding light source or optical element and along a direction transverse to the optical axis (O1, O2, O3, . . . On) of the light source (4)

the stage light fixture being characterized in that each light source (4) is coupled to a respective mixer device (24) which is arranged between the respective light source (4) and the respective lens (5) and is configured to collect the light beam emitted by the respective light source (4) and to mix it so as to generate a mixed and concentrated light beam.

2. Stage light fixture according to claim 1, wherein at least one light source (4) of the plurality of light sources (4) and the respective lens (5) of the plurality of lenses (5) are movable one with respect to the other along a direction parallel to the optical axis (O1, O2, O3, . . . On) of the light source (4).

3. Stage light fixture according to claim 1, wherein the plurality of light sources (4) and the plurality of lenses (5) rotate one with respect to the other on parallel planes.

4. Stage light fixture according to claim 1, wherein the plurality of light sources (4) or the plurality of lenses (5) translate one with respect to the other on parallel planes.

5. Stage light fixture according to claim 1, wherein one of the plurality of light sources (4) and the plurality of lenses (5) rotate one with respect to the other on planes inclined one with respect to the other.

6. Stage light fixture according to claim 1, wherein the plurality of lenses (5) comprises at least one first assembly (30) of lens (5) arranged one next to the other along a first path (P1) and wherein the plurality of light sources (4)

comprises a respective first assembly (35) of light sources (4) aligned and adapted to emit light beams hitting the first assembly (30) of lenses (5); the first assembly (30) of lenses (5) and the first assembly of light sources (4) being movable one with respect to the other along a direction transversal to the optical axis (O1, O2, O3, . . . On) of one of the light sources (4) of the first assembly of light sources (4).

7. Stage light fixture according to claim 6, wherein the plurality of lenses (5) comprises at least a second assembly (31) of lenses (5) arranged one next to the other along a second path (P2) and wherein the plurality of light sources (4) comprises a respective second assembly (36) of light sources (4) aligned and adapted to emit light beams hitting the second assembly (31) of lenses (5); the second assembly (31) of lenses (5) and the second assembly (36) of light sources (4) being movable one with respect to the other along a direction transversal to the optical axis (O1, O2, O3, . . . On) of one of the light sources (4) of the second assembly of light sources (4).

8. Stage light fixture according to claim 7, wherein the first path (P1) is first path (P1) is circular and the second path (P2) is circular, concentric to the first path (P1) and arranged inside the first path (P1).

9. Stage light fixture according to claim 7, wherein the first assembly (30) of lenses (5) is movable with respect to the first assembly (35) of light sources (4) and the second assembly (31) of lenses (5) is movable with respect to the second assembly (36) of light sources (4); the first assembly (30) of lenses (5) being movable independently from the second assembly (31) of lenses (5).

10. Stage light fixture according to claim 1, wherein the plurality of lenses (5) comprises at least two lenses (5) having emission faces (6) of different shape one from the other.

11. Stage light fixture according to claim 1, wherein the lenses (5) of the plurality of lenses (5) have polygonal-shaped emission faces (6).

12. Stage light fixture according to claim 1, wherein the toothed wheel (19) has a plurality of open spaces to permit the light beams of the respective lights sources (4) to pass through to the plurality of lenses (5).

13. Stage light fixture according to claim 1, wherein the device comprises a motor (22) that includes a shaft (21) with a pinion (20) that mates with teeth of the toothed wheel (19).

* * * * *